US007819393B2

(12) United States Patent
Padros et al.

(10) Patent No.: US 7,819,393 B2
(45) Date of Patent: Oct. 26, 2010

(54) WEB CUTTER HAVING A WEB CUTTER LOOP

(75) Inventors: Xavier A. Padros, New Milford, CT (US); Arthur H. DePoi, Brookfield, CT (US)

(73) Assignee: Pitney Bowes Inc., Stamford, CT (US)

( * ) Notice: Subject to any disclaimer, the term of this patent is extended or adjusted under 35 U.S.C. 154(b) by 432 days.

(21) Appl. No.: 11/581,026

(22) Filed: Oct. 13, 2006

(65) Prior Publication Data

US 2008/0106025 A1 May 8, 2008

(51) Int. Cl.
*B65H 37/00* (2006.01)

(52) U.S. Cl. ..... 270/52.09; 270/52.07

(58) Field of Classification Search ..... 270/5.02, 270/10, 52.07, 52.09, 52.12; 83/74, 75, 111, 83/287, 367, 408; 101/227; 226/44
See application file for complete search history.

(56) References Cited

U.S. PATENT DOCUMENTS 4,464,916 A * 8/1984 Grew et al. ..... 72/19.2
4,701,239 A * 10/1987 Craig ..... 156/519
5,768,959 A * 6/1998 Lorenzo ..... 83/74

* cited by examiner

*Primary Examiner*—Leslie A Nicholson, III
(74) *Attorney, Agent, or Firm*—Brian A. Collins; Angelo N. Chaclas

(57) ABSTRACT

A mail inserter has a first web driver to move a web from a web supply and a second web driver to feed the web to a cutter for cutting the web into sheets, wherein the first and second web drivers have different velocity profiles to allow a web loop to form between the web drivers. The loop is variable between a maximum size and a minimum size. When the loop reaches the minimum size, the first web driver is running at its maximum speed. At this point the first web driver is decelerated at a rate such that when the first web driver stops, the web loop is at its maximum size. The acceleration of the first web driver is at a constant rate which is inversely proportional to the difference between the maximum loop size and the minimum loop size.

17 Claims, 6 Drawing Sheets

WEB CUTTER HAVING A WEB CUTTER LOOP

TECHNICAL FIELD

The present invention relates generally to a mail processing machine and, more particularly, to the input portion of a high speed inserter system in which individual sheets are cut from a continuous web of printed materials for use in mass-production of mail pieces.

BACKGROUND OF THE INVENTION

Inserter systems, such as those applicable for use with the present invention, are mail processing machines typically used by organizations such as banks, insurance companies and utility companies for producing a large volume of specific mailings where the contents of each mail item are directed to a particular addressee.

In many respects, the typical inserter system resembles a manufacturing assembly line. Sheets and other raw materials (other sheets, enclosures, and envelopes) enter the inserter system as inputs. Then, a variety of modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

The input stages of a typical inserter system are depicted in FIG. 1*a*. At the input end of the inserter system, rolls or stacks of continuous printed documents, called a web, are provided at a web supply and fed into a web cutter where the continuous web is cut into individual sheets. In some inserter systems, the input stages of an inserter also include a right-angle turn to allow the individual pages to change their moving direction before they are fed into the inserter, as shown in FIG. 1*b*.

FIG. 2 illustrates the input stages of an inserter system wherein the continuous web material is provided in a fanfold stack. As shown in FIG. 2, the continuous web material 5 is drawn out of a fanfold stack 2. Typically, sheets in the continuous web material 5 are linked by perforations so that the web material can be driven continuously by a web driver 100 into a web-cutting module 200. The web-cutting module 200 has a cutter 210, usually in a form of a guillotine cutting blade, to cut the web material 5 crosswise into separate sheets 8.

In some inserter systems, the web material 5 must be split into two side-by-side portions by a cutting device 212 as shown in FIG. 3. The cutting device 212 may be a stationary knife or a rotating cutting disc. After the web material 5 is split into two side-by-side portions, it is cut crosswise by the cutter 210 into pairs of sheets 8I and 8II. The sheets 8I and 8II move side-by-side toward a right angle turn device so that they can move in tandem into an inserter system (not shown).

In other inserter systems, the web-material 5 has a row of sprocket holes on each side of the web material so that the web can be driven by a tractor with pins or a pair of moving belts with sprockets. As shown in FIG. 4, a pair of cutting devices 214 are used to separate the side strips containing the holes from the web material 5 before the web material is cut crosswise by the cutter 210. Additionally, some mechanical devices (not shown) are used to remove the side strips before the web-material is fed into the cutter 210.

In general, the web material is driven in move-and-pause cycles, wherein the web material is temporarily paused for a short period to allow the cutter to cut the material into cut sheets. Thus, in each cycle, the web must be accelerated and decelerated. When the acceleration is high, the forces created by the acceleration of the web mass by the driving belt can break the web at a perforation or cause the sprocket holes to tear. Thus, a jam occurs. When high throughput (20,000+ cycles per hour) is desired, the acceleration force-induced rip on the sprocket holes is a major limiting factor to the obtainable cycle rate. Furthermore, when the acceleration is high, another force is created by aerodynamic effects, due mainly to wind resistance against the motion of the web. The aerodynamics related force may also break the web at a perforation. For this reason, web cutters are usually operated at a cycle rate much lower than the obtainable cycle rate, affecting the throughput of the inserter system.

It is advantageous and desirable to provide a method to improve the throughput of web cutters while reducing the web breakage.

SUMMARY OF THE INVENTION

In order to minimize the forces applied to the web as it is being ingested into the cutter of an inserter system from a fanfold stack or a continuous roll, the present invention provides a web loop between the web handler axis that draws the web from the stack and the primary axis that feeds the web to a cutter module for cutting. A motion control module uses a web control algorithm to control the velocity of the web handler axis as a function of the web loop size using a constant acceleration. The parameters used in this velocity control function are calculated using the system conditions encountered during the worst case scenario. The worst case scenario is assumed when the web loop is at its minimum size; the web handler axis is running at its maximum velocity; and the primary web axis suddenly stops. At this point the web handler motor must decelerate at a rate such that when the axis stops, the web loop is at its maximum size.

In particular, the calculated acceleration is inversely proportional to the maximum web loop size, so that the larger the maximum web loop size is, the lower the acceleration required is, thus reducing the forces applied to the web. The desired web handler axis velocity decreases with an increasing web loop size, and when the web loop size reaches its maximum value, the web handler axis velocity is zero. From that point the desired web handler axis velocity will increase as the web loop gets smaller.

DETAILED DESCRIPTION

In order to reduce web breakage while operating a web cutter, the web handling device is designed to reduce the whipping motion of the web paper immediately upstream of the web cutter and the tension in the web due to the acceleration of the cutter tractor.

Figure 1A:
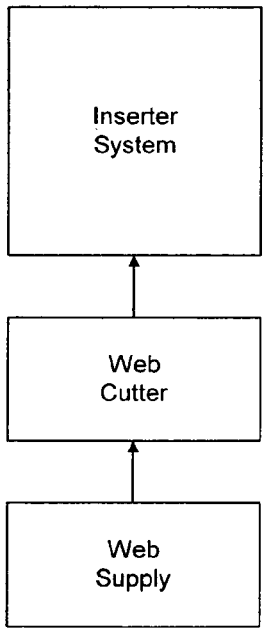
FIG. 1a (prior art)
FIG. 1*a* is a block diagram illustrating an inserter system having an inserter, a web cutter and a web supply.
Figure 1B:
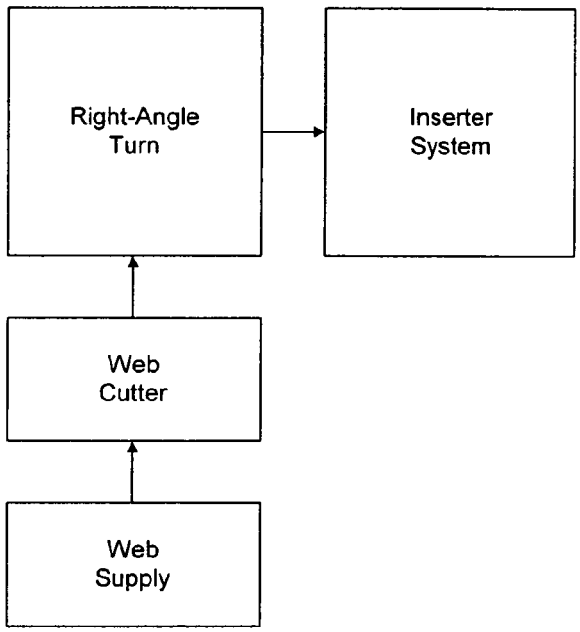
FIG. 1b (prior art)
FIG. 1*b* is a block diagram illustrating an inserter system wherein a right-angle turn module is positioned between an inserter and a web cutter.
Figure 2:
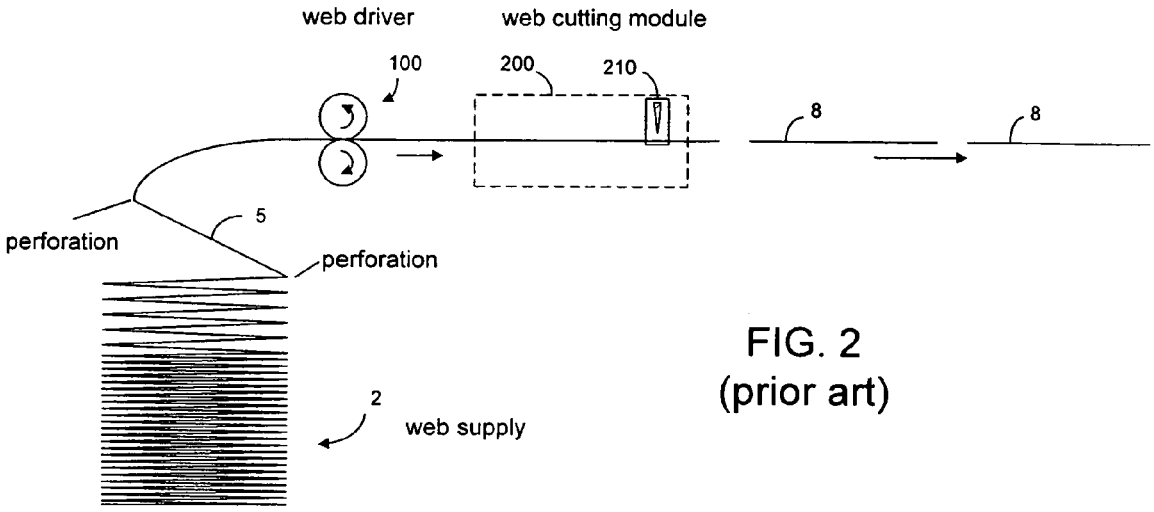
FIG. 2 (prior art)
FIG. 2 is a schematic representation of a web cutter.
Figure 3:
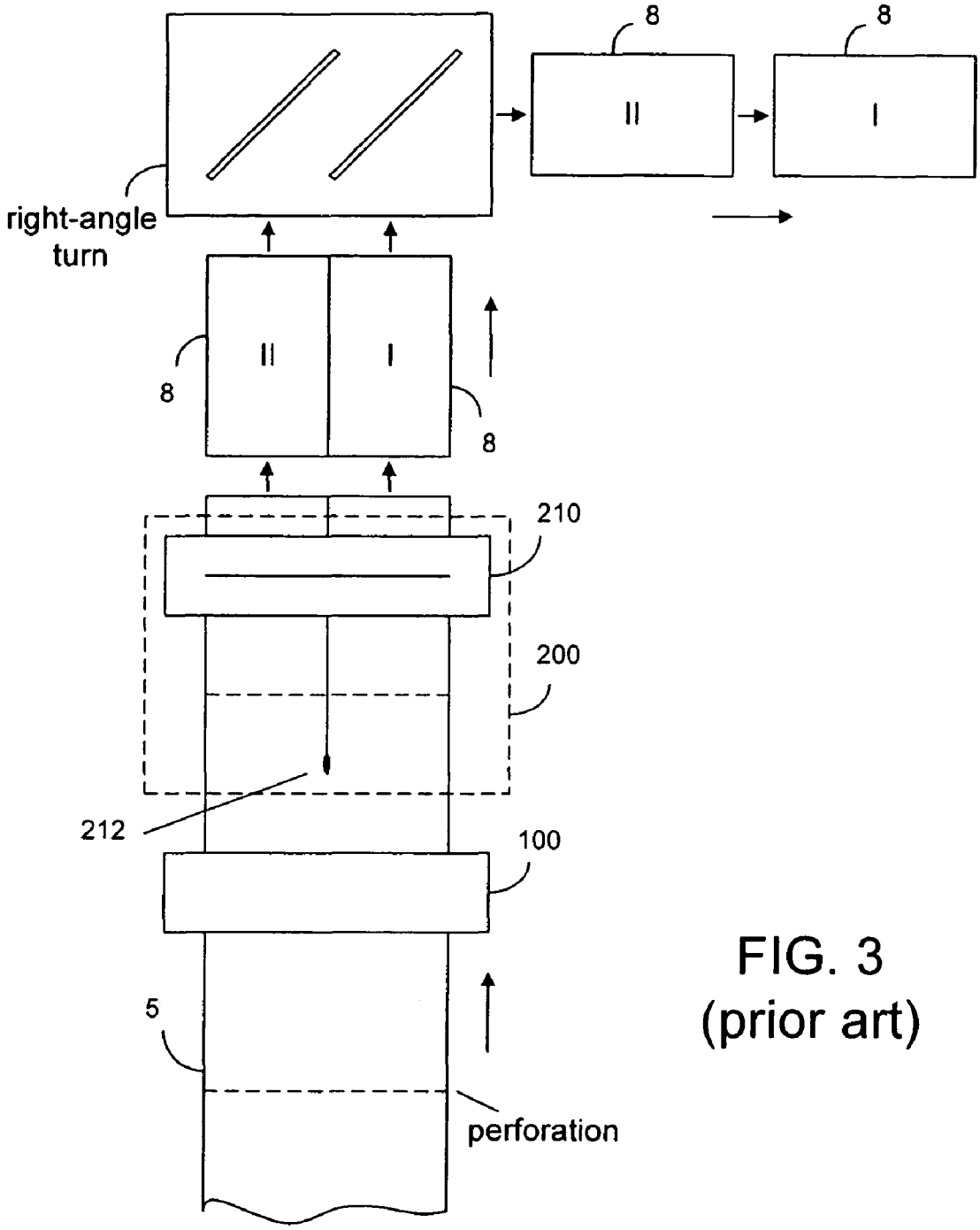
FIG. 3 (prior art)
FIG. 3 is a schematic representation of a web cutter for splitting a web into two side-by-side portions before separating the web into individual sheets.
Figure 4:
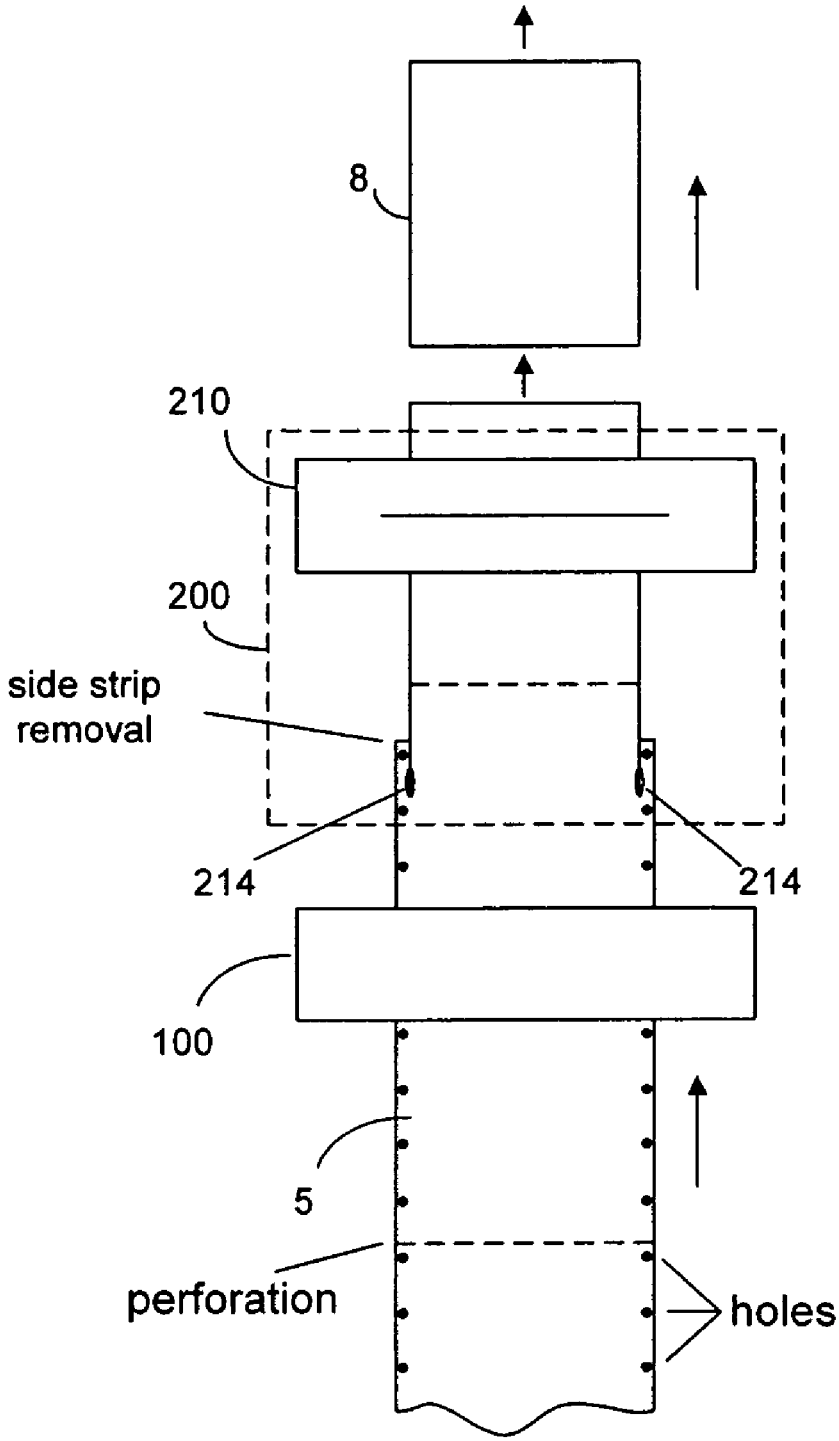
FIG. 4 (prior art)
FIG. 4 is a schematic representation of a web cutter having two cutting devices to remove the side strips from a web before separating the web into individual sheets.
Figure 5:
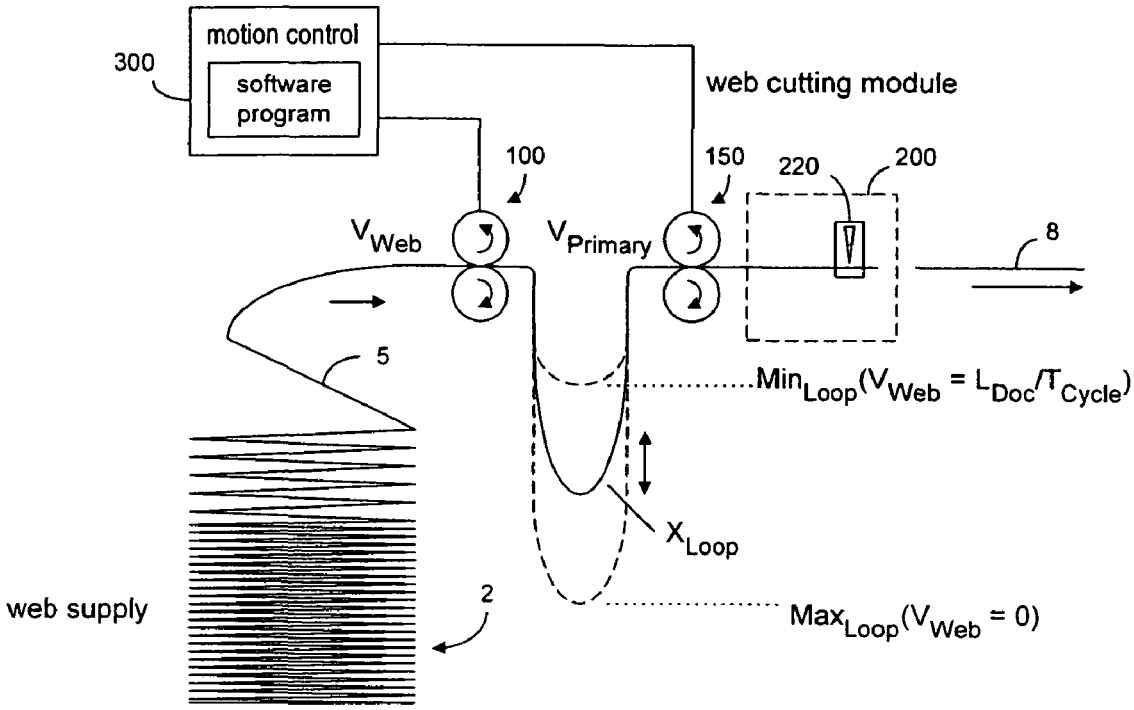
FIG. 5 is a schematic representation of a web cutter having a web loop, according to the present invention.

The web cutter, according to the present invention, uses a driver to move the web material from the web supply and a different driver to feed the web to the cutter. As shown in FIG. 5, the driver 150 is used to feed the web material 5 to the cutter module 200. It is preferred that the web material 5 is temporarily paused for a short period to allow the cutter 220 to cut the material into cut sheets 8. Thus, in each cycle, the web must be accelerated and decelerated. The driver 150 is referred to as the web primary axis. The driver 100 is used to move the web material from the web supply 2 and is referred to as the web handler axis. The main function of the web handler axis is to provide sufficient web material to the web primary axis. In order to reduce the whipping motion of the web material as it is moved from the web supply 2, the web handler axis has a different velocity profile.

If the amount of the web material advanced by the primary axis past the cutting blade in each cut cycle is $L_{DOC}$ and the time to complete one cut cycle is $T_{CYCLE}$, the web velocity at the web handler axis is equal to $V_{WEB}=L_{DOC}/T_{CYCLE}$, when the web cutter is in a steady state. When the primary axis is decelerated and paused to allow the cutter to cut the web, the web material driven by the web handler axis is allowed to accumulate between the two axes to form a loop, as shown in FIG. 5. When the primary axis is accelerated again in the next cycle, there should be a minimum amount of web material in the loop, such that, at no time before the primary axis stops, there is a tension in the web material at the web handler axis caused by the movement of the primary axis. Thus, it is preferable to allow some extra web material in the loop even when the cutter is operated at the steady state. This extra amount is shown as the minimum loop in FIG. 5.

In the event the primary axis stops longer than it does in the steady state, the loop will become longer. When the loop grows to a maximum amount that can be accommodated by the web cutter, the web handler axis should also be stopped. The maximum amount is shown as the maximum loop in FIG. 5. When the cutter resumes operation, the web handler axis starts again to keep up with the cutter so that the web loop size is never smaller than the minimum loop amount.

In order to minimize the forces applied to the web upstream as it is being ingested into the cutter from a fanfold stack or a continuous roll, a motion control module 300 is used to control the velocity of the web handler axis as a function of the web loop size using a constant acceleration. The parameters used in this velocity control function are calculated using the system conditions encountered during the worst case scenario. Since the algorithm used by the motion control module 300 is designed to handle the worst case conditions, all other possible conditions are handled properly by the algorithm. In the inserter system, according to the present invention, the worst case scenario is encountered when the web loop is at its minimum size; the web handler axis is running at its maximum velocity; and the primary web axis suddenly stops. At this point the web handler motor must decelerate at a rate such that when the web handler axis stops, the web loop is at its maximum size.

In particular, the algorithm for controlling the velocity of the web handler axes is governed by the following equations, for example:

$$A_{WEB}=\tfrac{1}{2}*(L_{DOC}/T_{CYCLE})^2/(\mathrm{Max}_{LOOP}-\mathrm{Min}_{LOOP}) \quad (1)$$

$$V_{WEB}=\mathrm{sqrt}(2*A_{WEB}*(\mathrm{Max}_{LOOP}-X_{LOOP})) \quad (2)$$

where $V_{WEB}$:=Desired velocity of web handler axis $A_{WEB}$:=Acceleration of web handler axis $L_{DOC}$:=Amount of web primary axis advances in each cut cycle $T_{CYCLE}$:=Time to complete one cut cycle $\mathrm{Max}_{LOOP}$:=Maximum amount of web stored in the loop $\mathrm{Min}_{LOOP}$:=Minimum amount of web stored in the loop $X_{LOOP}$:=Actual amount of web stored in the loop.

The first step to implement the algorithm is to limit the web handler axis acceleration to a constant value ($A_{WEB}$) which needs to be calculated based on several system design parameters (see Equation 1). The calculated acceleration is inversely proportional to the maximum web loop size, so that the larger the maximum web loop size is, the lower the acceleration required is, thus reducing the forces applied to the web. At runtime, the motion control module calculates the desired web handler axis velocity ($V_{WEB}$) which decreases with an increasing web loop size (see Equation 2). The desired web handler axis velocity will be zero when the web loop is at its maximum size. From that point the desired web handler axis velocity will increase as the web loop gets smaller. The web handler algorithm commands to the web handler axis motor a positive acceleration when the desired web velocity is greater than the actual web velocity and a negative acceleration when the desired web velocity is smaller that the actual web velocity. When the web loop reaches the minimum loop size, it is preferable that the web handler velocity is such that the web moved by the web handler axis is equal to the amount of web material advanced by the primary axis in each cut cycle. Thus, the web handler velocity is equal to $L_{DOC}/T_{CYCLE}$ when the actual web loop reaches the minimum loop size.

Figure 6:
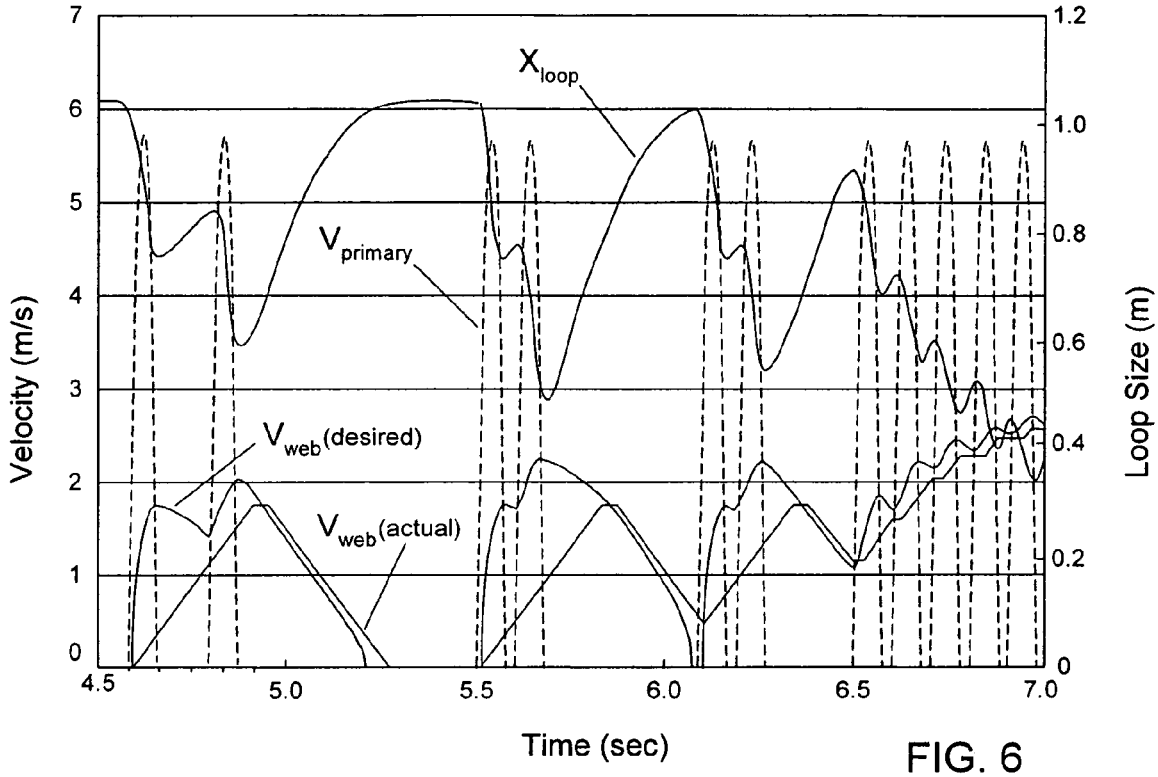
FIG. 6 is a time-chart showing the velocity profile of the web handler axis and that of the primary axis, and the variation of the loop size.

The desired web handler velocity ($V_{WEB}$) is calculated at each sample interval of the web loop, which changes size as a function of the velocity differential between the actual velocities of the primary and web handler axes. In most cases, this desired velocity profile defines a motion path that the actual velocity profile cannot match and will usually lag behind unless the system achieves a steady state. This characteristic is central to this algorithm as it allows the web loop to act as a dampening device between the primary and web handler axes. The algorithm is not designed as a direct control loop of the desired web handler velocity versus the actual web handler velocity, but rather as a means to manage the web loop size such that it never exceeds its minimum and maximum boundaries while keeping the web loop inlet acceleration to a minimum. An example of the velocity profile of the web handler axis (desired and actual) and that of the primary axis are shown in FIG. 6.

To further improve the smooth handling of the web as it is being ingested, an anti-hunting algorithm is overlaid on top of the main velocity control algorithm as expressed in Equation 1 and Equation 2. The main velocity control algorithm will always command a change in velocity unless the desired and actual velocities are exactly the same. As shown in FIG. 6, the desired and actual velocities do differ from one another. Thus, the main velocity control algorithm will command a change in the velocity. This behavior will cause the desired web handler speed to oscillate around a constant value when the system achieves a steady state. To prevent this oscillation, or hunting, the acceleration is forced to zero when the velocity delta between the desired and actual velocities is within a predefined range.

In sum, the web cutter, according to the present invention, uses at least two web drivers to move the web. One web driver is used to feed the web to a web cutter in move-and-pause cycles. Another web driver in the upstream has a constant velocity profile or any waveform with a gentler slope at least in the acceleration period. As such, a loop is formed between the web drivers. The web material in the loop is sufficient to be advanced past the cutter in each cut cycle. A motion control having a software program is used to regulate the web flow by quickly delivering the web when it is needed. At the same time, the acceleration of the web material as it is moved from the web supply by the web handler drive is reduced or eliminated. The accumulation of the web material in the loop resembles a web capacitor that is used for storing the web material ahead of time and rapidly discharging it when it is needed. By limiting the force applied to the web, web breakage can be reduced.

What is claimed is:

1. A method for controlling a web in a web cutter, the web cutter having a cutter module for cutting the web into sheets, a first web driver for moving the web from a web supply and a second web driver downstream from the first web driver for feeding the web to the cutter module, said method comprising:

driving the first web driver for achieving a first web velocity having a first velocity profile;

driving the second web driver for achieving a second web velocity having a second velocity profile, wherein the second velocity profile is different from the first velocity profile so as to allow a web loop to form between the first web driver and the second web driver, the web loop having a variable loop size between a minimum loop size and a maximum loop size;

controlling at least the first web driver such that, at least in a portion of web cutter operation, the first web velocity increases when the web loop size decreases until the web loop size reaches the minimum loop size, and the first web velocity decreases when the web loop size increases until the web size reaches the maximum loop size, wherein controlling at least the first web driver comprises calculating a desired web velocity at each sample interval of the web loop to achieve the first web velocity.

2. The method of claim 1, wherein when the web loop size reaches the maximum loop size, the first web velocity is substantially equal to zero.

3. The method of claim 1, wherein when the web loop size reaches the minimum loop size, the first web velocity is equal to a maximum value determined at least based on a throughput of the web cutter.

4. The method of claim 3, wherein the throughput is determined based on an amount of web material advanced by the second web driver in each cut cycle divided by a time period to complete said cut cycle.

5. The method of claim 3, wherein the first web driver is accelerated substantially at a constant rate to increase the first web velocity until the first web velocity reaches the maximum value.

6. The method of claim 5, wherein the constant rate is inversely proportional to a difference between the maximum loop size and the minimum loop size.

7. The method of claim 6, wherein the first web velocity is proportional to the square root of the constant rate.

8. The method of claim 6, wherein the first web velocity is proportional to the square root of the difference between the maximum loop size and the web loop size.

9. A web cutter comprising:

a cutter module for cutting a web into sheets;

a first driver for moving the web from a web supply at a first web velocity having a first velocity profile;

a second web driver downstream from the first web driver for feeding the web to the cutter module at a second web velocity having a second velocity profile, wherein the second velocity profile is different from the first velocity profile, so as to allow a web loop to form between the first web driver and the second web driver, and the web loop has a variable loop size between a minimum loop size and a maximum loop size; and a motion control module for controlling at least the first web driver such that, at least in a portion of web-cutter operation, the first web velocity increases when the web loop size decreases until the web loop size reaches the minimum loop size, and the first web velocity decreases when the web loop size increases until the web loop size reaches the maximum loop size, wherein controlling at least the first web driver comprises calculating a desired web velocity at each sample interval of the web loop to achieve the first web velocity.

10. The web cutter of claim 9, wherein when the web loop size reaches the maximum loop size, the first web velocity is substantially equal to zero.

11. The web cutter of claim 9, wherein when the web loop size reaches the minimum loop size, the first web velocity is equal to a maximum value determined at least based on a throughput of the web cutter.

12. The web cutter of claim 11, wherein the throughput is determined based on an amount of web material advanced by the second web driver in each cut cycle divided by a time period to complete said cut cycle.

13. An inserter system for inserting sheets into envelopes, comprising a web cutter as claimed in claim 9.

14. The web cutter of claim 9, wherein the first web driver is accelerated substantially at a constant rate to increase the first web velocity until the first web velocity reaches the maximum value.

15. The web cutter of claim 14, wherein the constant rate is inversely proportional to a difference between the maximum loop size and the minimum loop size.

16. The web cutter of claim 15, wherein the first web velocity is proportional to the square root of the constant rate.

17. The web cutter of claim 15, wherein the first web velocity is proportional to the square root of the difference between the maximum loop size and the web loop size.

* * * * *